US005618852A

United States Patent [19]

Adkins

[11] Patent Number: 5,618,852

[45] Date of Patent: Apr. 8, 1997

[54] USED TIRE PROCESS

[76] Inventor: Lorato Adkins, 8601 S. Francisco, Chicago, Ill. 60652

[21] Appl. No.: 491,810

[22] Filed: Jun. 19, 1995

[51] Int. Cl.[6] ..... C08J 11/00; C08J 11/26

[52] U.S. Cl. ..... 521/43.5; 521/41; 521/42; 521/42.5; 521/44; 521/44.5; 524/572

[58] Field of Search ..... 521/41, 42, 42.5, 521/43.5, 44, 44.5; 524/572

[56] References Cited

U.S. PATENT DOCUMENTS 5,070,109 12/1991 Ulick et al. ..... 521/41
5,157,176 10/1992 Munger ..... 585/241

*Primary Examiner*—Paul R. Michl
*Assistant Examiner*—Olga Asinovsky
*Attorney, Agent, or Firm*—Joanne M. Denison

[57] ABSTRACT

A method of processing used tires and the recovery of the products thereof. The process includes adding shredded automobile tire to a bath containing a combination of isocyanide, polyurethane, latex, and soybean oil. The resultant mixture is then heated at approximately 700° F. for a period of 10 minutes. The process allows the recovery of the following products, including but not limited to: oil, steel, vinyl chloride, and carbon. The addition of soybean oil to the bath mixture provides a safer and more economical process. The current process does not require the use of a special atmosphere nor does it require the use of a high pressure system.

6 Claims, 1 Drawing Sheet

USED TIRE PROCESS

BACKGROUND OF THE INVENTION

The present invention relates to the field of recycling used tires. More particularly, the present invention relates to a method of processing used tires and the recovery of products thereof.

The recycling of used tires and the recovery of component products is known in the art. However, many previous methods have sought to reclaim only a single product. This strategy has been used where it is economically feasible to recover the component product to be reclaimed. Other methods have reprocessed used tires with the idea of converting the resulting component products into new functional materials. Some processes have sought to reprocess the used tires into crude oil, while others have attempted to reprocess used tires into rubber strips or useful resins.

Schmidt, U.S. Pat. No. 5,127,588 discloses a machine for reducing vehicle tires to small chip-like particles. The Schmidt "tire chipper" is representative of the first step in the process used to reclaim materials from used tires.

In Stapp, U.S. Pat. No. 5,158,983, a process for converting tire scrap to useful oil, especially crude oil, is disclosed. This process uses a hydrogen atmosphere and a temperature of approximately 350° C.–450° C. This process also utilizes a preferred pressure of 750–3,000 psi and a preferred processing time between 30 minutes and 4 hours. This process is representative of the high energy input required for the reprocessing of used automobile tires. Further, the presence of a hydrogen atmosphere, in combination with the high temperatures, presents a potentially dangerous processing method.

Johnson, et al., U.S. Pat. No. 2,478,826, discloses a method of reclaiming Buna N type rubber (synthetic rubber) by means of using phenyl-beta-naphthylamine, at atmospheric pressure, at approximately 250° F.–350° F. for 6–10 hours. This process also utilizes a pressure of approximately 60–75 psia. This process represents a way of reclaiming synthetic rubber, however, it does not teach the reprocessing of used automobile tires.

In Price, U.S. Pat. No. 693,151, a process for reclaiming rubber from vulcanized rubber waste is disclosed. The Price process utilizes a superheated fluid to bathe the vulcanized rubber waste which is heated to approximately 300° C.–450° C. This process uses high temperatures and low pressures due to the superheated fluid. The liquid bath contains hyposulfite of soda which has the effect of preventing further oxygenation of the rubber waste, which would produce a further vulcanization. The soda solution also functions to remove the sulfur from the rubber waste. However, this process is a closed process utilizing superheated steamed heat and as such presents the dangers associated with such processes.

Merges, U.S. Pat. No. 3,460,769, discloses a method and apparatus for reclaiming rubber scrap. The Merges method also discloses the use of swelling additives, like oil, and the use of heat in order to plasticize the scrap material. However, the Merges process discloses the use of centrifugal forces which simultaneously expose the scrap in a pulsating manner to friction, milling, shearing, and crushing forces. Further, the Merges process does not disclose the optimization of the swelling procedure, nor does it describe the different properties of the swelling agents.

In Massoubre, U.S. Pat. No. 3,563,922, a method of regenerating vulcanized rubber, resulting products, and compositions containing the regenerating products, is disclosed. The process described includes the steps of taking the finely divided vulcanized rubber, using a swelling agent to plasticize the rubber, adding a devulcanization agent to the rubber, and heating the rubber and solvent mixture within the temperature range of 180° C.–230° C. for two to three hours. The oil used as plasticizer is used in a ratio in the preferred embodiment of 65%–100% oil to scrap. The Massourbre process discloses solvents which include mineral oils obtained by the distillation of petroleum oil or coal, vegetable and animal oils consisting of the glyceric esters of fatty acids, and compounds of the above oils. The vegetable and animal oils disclosed are castor oil and paraffin. In the examples disclosed, both the vegetable and animal oils are used in combination with mineral oils. The Massoubre process requires subjecting the scrap to relatively low temperatures, for long periods of time, and in the presence of large amounts of oil as seen in the oil to scrap ratio.

SUMMARY OF THE INVENTION

Accordingly, the present invention provides an alternative to the problems of the prior art by providing a method of processing used tires and the recovery of the products thereof. The process may be described as adding shredded automobile tire to a bath containing a combination of isocyanide, polyurethane, latex, and soybean oil. The resultant mixture is then heated at approximately 700° F. for a period of 10 minutes. This process allows the recovery of the following products, including but not limited to: oil, steel, vinyl chloride, and carbon. The addition of soybean oil to the bath mixture is not only novel, but makes the process one which is economical and safe avoiding many of the problems with the prior art. Further, the current process does not require the use of a special atmosphere nor does it require the use of a high pressure system. Additionally, the use of medium range temperatures for a short amount of time makes the energy input and thus the price of the process relatively modest compared to that of the prior art. Economically, the use of soybean oil is the major distinguishing factor in this invention, as is shown by the common availability of soybean oil as well as the cost of obtaining the oil. Further, the process allows for the economic recovery of raw materials which may be sold to users of such raw materials.

OBJECTS OF THE INVENTION

It is an object of the present invention to provide a method of processing used automobile tires utilizing a bath of soybean oil, latex, polyurethane and isocyanide.

It is another object of the present invention to provide an inexpensive and safe method of recovering materials such as oil, steel, vinyl chloride, and carbon from used automobile tires.

It is yet another object of the present invention to provide an economical method of reprocessing used automobile tires by utilizing a low energy, low cost process using inexpensive and commonly available materials.

It is still another object of the present invention to provide a fast & efficient method of processing used automobile tires, wherein the method is many times shorther than those seen heretofore.

These and other objects and advantages of the present invention can be readily derived from the following detailed description of the process taken in conjunction with the accompanying drawing present herein and should be considered as within the overall scope of the invention.

DETAILED DESCRIPTION OF THE PREFERRED EMBODIMENTS

Figure 1:
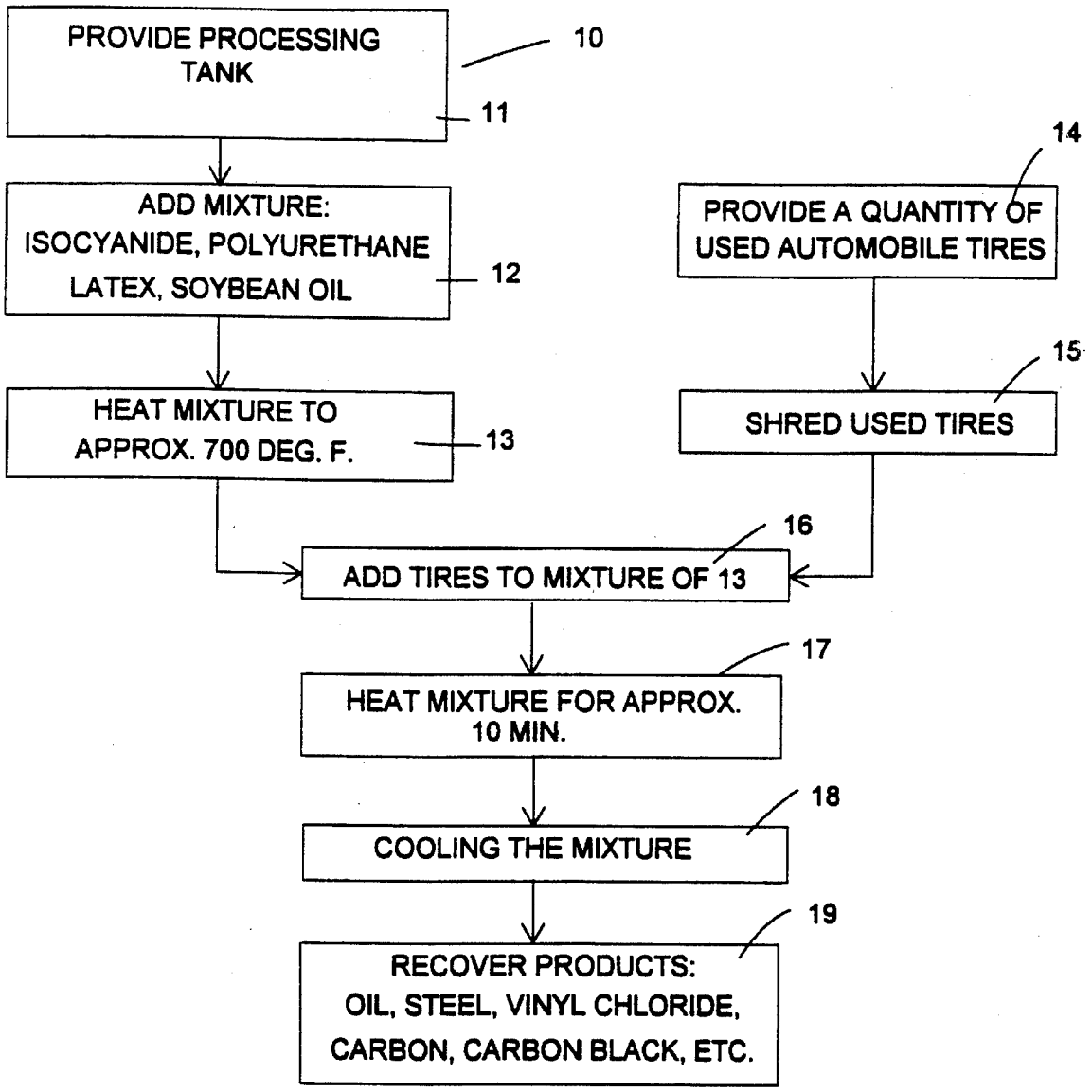
FIG. 1 is a diagram showing a preferred embodiment of the steps used in the used tire process.

In the drawings, FIG. 1 is a diagram showing a preferred embodiment of the steps used in the used tire process 10. FIG. 1 shows the preparatory steps of providing a processing tank 11, adding a mixture of isocyanide, polyurethane, latex, and soybean oil to the tank 12, and heating the mixture to approximately 700 degrees Fahrenheit 13. The steps of providing a quantity of used automobile tires 14 and shredding the quantity of used automobile tires 15 are also preparatory in nature. The preparatory steps converge, as shown in FIG. 1, at the step of adding a quantity of used shredded automobile tires to the mixture 16. From there the process continues with the steps of heating the tires mixture for approximately ten (10) minutes 17, followed by cooling the mixture 18, and recovering products from the mixture including, but not limited to oil, steel, vinyl chloride, and carbon 19.

The processing tank 11 is able to withstand relatively high temperatures, i.e., 700 degrees Fahrenheit, and is constructed to include a heating apparatus as part of the processing tank. In a preferred embodiment, the processing tank is made of stainless steel or glass. However, high temperature alloys, as well as composite tanks are contemplated as within the scope of the process.

The step of adding a mixture of isocyanide, polyurethane, latex and soybean oil in a preferred embodiment includes adding, by volume, 20% isocyanide, 20% polyurethane, 20% latex, and 40% soybean oil. The mixture or bath of the above ingredients is varied depending upon the composition of the tire being processed. The soybean oil is used as a plasticizer in a preferred embodiment. The soybean oil may be epoxidized depending on the particular application. The boiling point of soybean oil is shown in comparison to other compounds in the following chart:

TABLE 1

| | Mp of ester, DEGREES C. | Bp of ester**b, DEGREES C. |
|---|---|---|
| furoic | 14–14.5 | 182–184 |
| coumarilic | 45–45.5 | 135 |
| 2-thiophenecarboxylic | | 84–87 |
| 2-thionaphthencarboxylic | 57–58 | 124–129 |
| nicotinic | | 105–108 |
| p-toluenesulfonic | | 106–107.5 |
| naphthalene-2-sulfonic | | 150–160 |
| SOYBEAN OIL | | 195–200 |
| linseed oil | | |
| N-acetylphenylglycine | | |
| N-acetyl-2-amino-4,6, 6-trimethyl-heptanoic | | |
| 9,10-epoxystearic | 22.2–22.6 | 163 |

Table 2 shows the pressure at the boiling point determination in comparison to other compounds.

TABLE 2

| | Pressure of bp determination, Pa**c |
|---|---|
| furoic | 1330 |
| coumarilic | 70 |

TABLE 2-continued

| | Pressure of bp determination, Pa**c |
|---|---|
| 2-thiophenecarboxylic | 1330 |
| 2-thionaphthencarboxylic | 27 |
| nicotinic | 1600 |
| p-toluenesulfonic | 40 |
| naphthalene-2-sulfonic | 70 |
| SOYBEAN OIL | 1070 |
| linseed oil | |
| N-acetylphenylglycine | |
| N-acetyl-2-amino-4,6, 6-trimethyl-heptanoic | |
| 9,10-epoxystearic | 9 |

Table Footnotes:
**a Refs. 42, 43.
**b At 101.3 kPa (= 760 mm Hg) unless noted in the next column.
**c To convert Pa to mm Hg, divide by 133.

Although the exact mechanism of action of the soybean oil is unknown, the useful properties may consist of the mixture of compounds within soybean oil, or in one of the compounds present in soybean oil. Some compounds present in soybean oil include: the antioxidant beta-Tocopherol; 5-Hexyltetrahydro-2-furanoctanoic acid present in heat treated soybean oil; and, 9,10-Epoxy-12,15-octadecadienoic acid present as a minor component in soybean oil.

The exact mechanism of action regarding the isocyanide is also unknown. However, isocyanides, particularly poly-(alpha-phenylethyl)isocyanide, are thought to depress freezing points and provide stabilization of polymers at high temperatures. The polyurethane, latex and the soybean oil all act as swelling agents and plasticizers to aid in the softening and degradation of the tire materials.

The process is used for the recovery of used automotive tires. However, the process may be used for the recovery of products from other types of scrap rubber products due to the economics of utilizing soybean oil in the bath mixture. The tires must be shredded before their addition to the bath and are preferably reduced in size to a course ground or better.

The shredded tires are then added to the bath for approximately 10 minutes. If the processing time is lengthened, it will reduce the quality of the carbon in the tire, and make recovery of the and the carbon black from the tires inefficient. Further, if the processing time is less than 10 minutes, the resulting mixture is too elastic and tough. The optimization of the heating process is important due to the fact that zinc oxide is added to automobile tires in order to dissipate the heat resulting from use of the tires. Thus, the addition of zinc oxide to the automobile tires allows them to last much longer than tires without the additional zinc oxide. Further, if the temperature is less than 400° F., the process described herein will not work and the resulting admixture is viscous and sticks to the processing equipment. If the processing temperature is greater than 700° F., the process runs into equipment failure such as the breakdown of the processing tank.

Although in the foregoing detailed description, the present invention has been described by reference to a particular embodiment, it is to be understood that modifications and alterations in the processing steps related therein other than those specifically set forth herein may be achieved by those skilled in the art and that such modifications and alterations are to be considered as within the scope of this invention.

I claim:

1. The method of processing used tires and recovery of products thereof, comprising the steps of:

providing a suitable processing tank;

adding an appropriate amount of processing bath to said tank wherein said processing bath includes soybean oil, heating said processing bath to a temperature substantially within the range 400° F.–700° F.;

adding suitably ground used automotive tires to said bath;

processing said tires for a period of ten to thirty minutes; and recovering useful raw material products wherein said products are comprised of one or more taken from the following group:

oil, steel, vinyl chloride, and carbon.

2. The process of claim 1 wherein providing a processing bath includes providing one or more taken from the following group: isocyanide, polyurethane, latex, and soybean oil.

3. The process of claim 1 wherein the processing bath is heated to a temperature of substantially 700° F.

4. The process of claim 1 wherein the mixture is processed for substantially 10 minutes.

5. The process of claim 1 wherein providing a suitable soybean oil bath includes providing isocyanide 10%–30% by weight, polyurethane 10%–30% by weight, latex 10%–30% by weight, and soybean oil 30%–50% by weight.

6. The process according to claim 2 wherein providing a suitable soybean oil bath includes providing isocyanide 10%–30% by weight, polyurethane 10%–30% by weight, latex 10%–30% by weight, and soybean oil 30%–50% by weight.

* * * * *